US006761163B1

(12) United States Patent
Toth

(10) Patent No.: US 6,761,163 B1
(45) Date of Patent: Jul. 13, 2004

(54) INFLATOR REGULATOR WITH MULTIPLE ADAPTERS FOR CONNECTION TO DIFFERENT SIZE BC HOSES

(76) Inventor: Douglas J. Toth, 8422 Dallas Cir., Huntington Beach, CA (US) 92646

( * ) Notice: Subject to any disclaimer, the term of this patent is extended or adjusted under 35 U.S.C. 154(b) by 0 days.

(21) Appl. No.: 10/347,608

(22) Filed: Jan. 21, 2003

(51) Int. Cl.[7] ..... B63C 11/02

(52) U.S. Cl. ..... 128/201.27; 128/202.14; 128/202.27; 128/205.22; 128/200.25; 441/88; 441/92; 441/96; 441/99

(58) Field of Search ..... 128/200.25, 200.29, 128/201.11, 201.27, 202.27, 201.26, 201.28, 201.29, 206.29, 200.24, 202.14, 204.18, 205.22; 405/186, 187; 441/88, 92, 96, 99, 106, 108, 112–119

(56) References Cited

U.S. PATENT DOCUMENTS 4,227,521 A 10/1980 Hart et al.
4,812,083 A * 3/1989 Mosier ..... 405/186
5,060,689 A * 10/1991 Csaszar et al. ..... 137/515
5,417,204 A * 5/1995 Moesle, Jr. ..... 128/205.23
5,584,287 A * 12/1996 Smith et al. ..... 128/202.22
5,620,314 A * 4/1997 Worton ..... 417/550
6,209,804 B1 * 4/2001 Spriegel ..... 239/373
6,328,058 B1 * 12/2001 Perrone, Jr. ..... 137/240

* cited by examiner

*Primary Examiner*—Glenn K. Dawson
*Assistant Examiner*—Michael Mendoza
(74) *Attorney, Agent, or Firm*—Leonard Tachner

(57) ABSTRACT

Inflator regulator having a threaded sleeve and a plurality of different size adapters for connection to a plurality of different size BC hoses. Connecting the inflator regulator to a selected BC hose is accommodated by selecting the corresponding size adapter. The selected adapter is inserted concentrically through the threaded sleeve and then mechanically affixed, such as by a plastic cable tie, to the end of the BC hose. The sleeve is then threaded onto the inflator regulator. In the event that it is desired to connect to a different size BC hose, the above process is simply reversed and repeated using an appropriately selected different adapter.

4 Claims, 4 Drawing Sheets

INFLATOR REGULATOR WITH MULTIPLE ADAPTERS FOR CONNECTION TO DIFFERENT SIZE BC HOSES

BACKGROUND OF THE INVENTION

1. Field of the Invention

The present invention relates generally to the field of scuba diving equipment and more particularly to an inflator or inflator regulator that can mate with different size BC hoses.

2. Background Art

Scuba diving is a sport which has many risks. One such risk is a regulator malfunction or other such problem that makes it difficult or impossible to breath air. A diver cannot tolerate being denied breathable air for very long. One way of countering the risk is to provide an alternate air source regulator that is connected to the first stage regulator to be used in the event that the primary second stage regulator is not available. Another diving risk is the urgent need to rapidly come to the surface without the ability to do so quickly enough. The way this risk is countered is by providing an inflator for the buoyancy compensator that permits a rapid increase in buoyancy by directing pressurized air from the first stage regulator to the BC to pull the diver to the surface.

Historically, these two safety features have been implemented as two separate pieces of scuba diving equipment. One such piece of equipment is the backup second stage regulator and the other is the inflator for the buoyancy compensator. Each is connected by separate hoses to the first stage regulator. In the last twenty years or so, manufacturers have been offering a single piece of equipment which combines these two distinct functions. This piece of equipment is commonly referred to as an inflator regulator and it requires that only one hose be connected to the first stage regulator rather than two. Moreover, it permits the diver to breath through the same device that he or she can use to control their buoyancy. One such integrated inflator and auxiliary second stage regulator is disclosed in U.S. Pat. No. 4,227,521 to Hart et al, the content of which is hereby incorporated herein by reference for purposes of background information.

These integrated devices typically have two hoses, one connected to the buoyancy compensator and one connected to the first stage regulator. The hose that connects to the BC is usually a corrugated hose which connects to the inflator regulator by means of plastic cable ties or other mechanical clamp. Normally, they are not easily removable from the inflator regulator and are sometimes even glued for security. There are a variety of hose styles and diameters that differ between manufacturers. As a result, a diver having a particular manufacturer's BC will be constrained to purchase an inflator regulator from the same manufacturer so that it will properly connect to the compensator inflator hose. This is a distinct disadvantage to those divers who prefer the inflator regulator of a different manufacturer, but who also prefer not to purchase a new buoyancy compensator just to acquire the appropriate hose to connect to the inflator regulator.

It would therefore be highly advantageous if it were possible to provide an inflator or an inflator regulator that can be configured to connect to a plurality of different BC hose sizes and so that the diver can readily remove the inflator or inflator regulator from one BC and use it on another.

SUMMARY OF THE INVENTION

The present invention comprises a unique inflator or inflator regulator having a threaded sleeve and a plurality of different size adapters for connection to a plurality of different size BC hoses. Connecting the inflator or inflator regulator to a selected BC hose is accommodated by selecting the corresponding size adapter. The selected adapter is inserted concentrically through the threaded sleeve and then mechanically affixed, such as by a plastic cable tie, to the end of the BC hose. The sleeve is then threaded onto the inflator or inflator regulator. In the event that it is desired to connect to a different size BC hose, the above process is simply reversed and repeated using an appropriately selected different adapter.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF A PREFERRED EMBODIMENT

Figure 1:
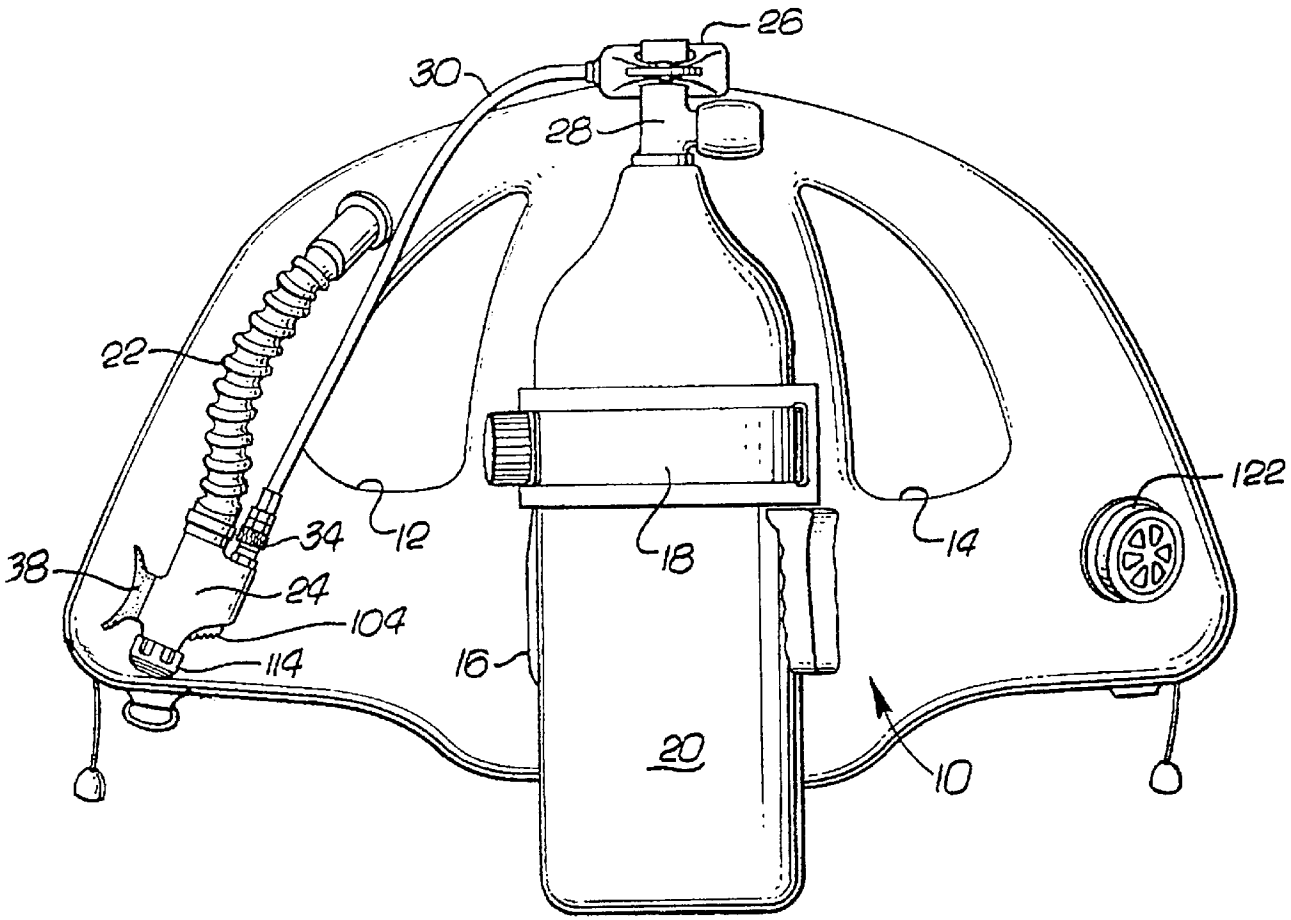
FIG 1 (PRIOR ART)
FIG. 1 is a prior art drawing showing a conventional BC with a conventional inflator regulator attached thereto.

Referring to prior art FIG. 1 it will be seen that a conventional buoyancy bag 10 in the form of a jacket has arm holes 12 and 14. Attached to the jacket is a rigid back pack 16 that includes a band 18 for releasably clamping a tank 20 to the pack. The tank 20 contains air under high pressure.

The jacket is inflatable through a large diameter flexible hose 22, one end of which is fitted to the jacket 10, and the other end of which is attached to a regulator body 24. The proximal end of the hose is located adjacent the left shoulder region in front of the arm hole 12.

For normal inflator regulator operation, air from the high pressure tank 20 is conducted to the regulator body 24 for use by the diver as he demands it. For this purpose, a conventional first stage regulator 26 is detachably connected, as by a yoke and screw device, to a high pressure valve 28 inserted into the neck of the tank 20. The first stage regulator 26 delivers air to flexible pressure line 30 at about 125 or 140 p.s.i. above ambient, all in a well understood manner.

The pressure line 30 connects to the regulator body 24 by the aid of a quick disconnect coupling 34. On the front of the regulator body 24 a mouthpiece 38 is fitted. Air is conducted to a breathing chamber via a demand valve that opens in response to lowering of pressure in the breathing chamber as by inhalation.

Inflation and deflation of the buoyancy bag 10 is achieved by engaging one of two actuators 104 and 114 depending on the desired direction of air flow. A relief valve 122 prevents over-inflation of the BC.

Figure 2:
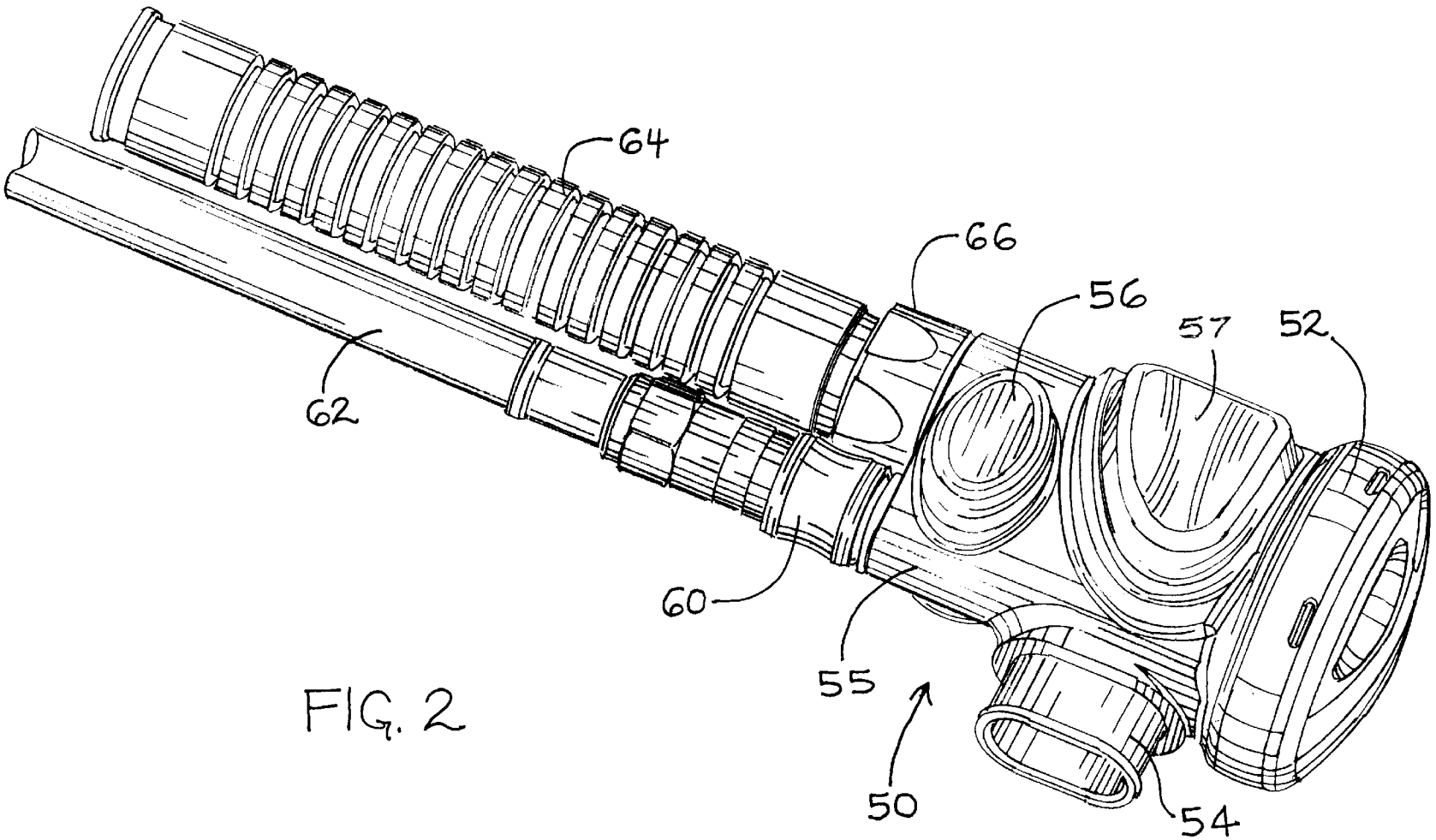
FIG. 2 is a view of an inflator regulator of the invention shown connected to BC hose and to a first stage regulator hose.
Figure 3:
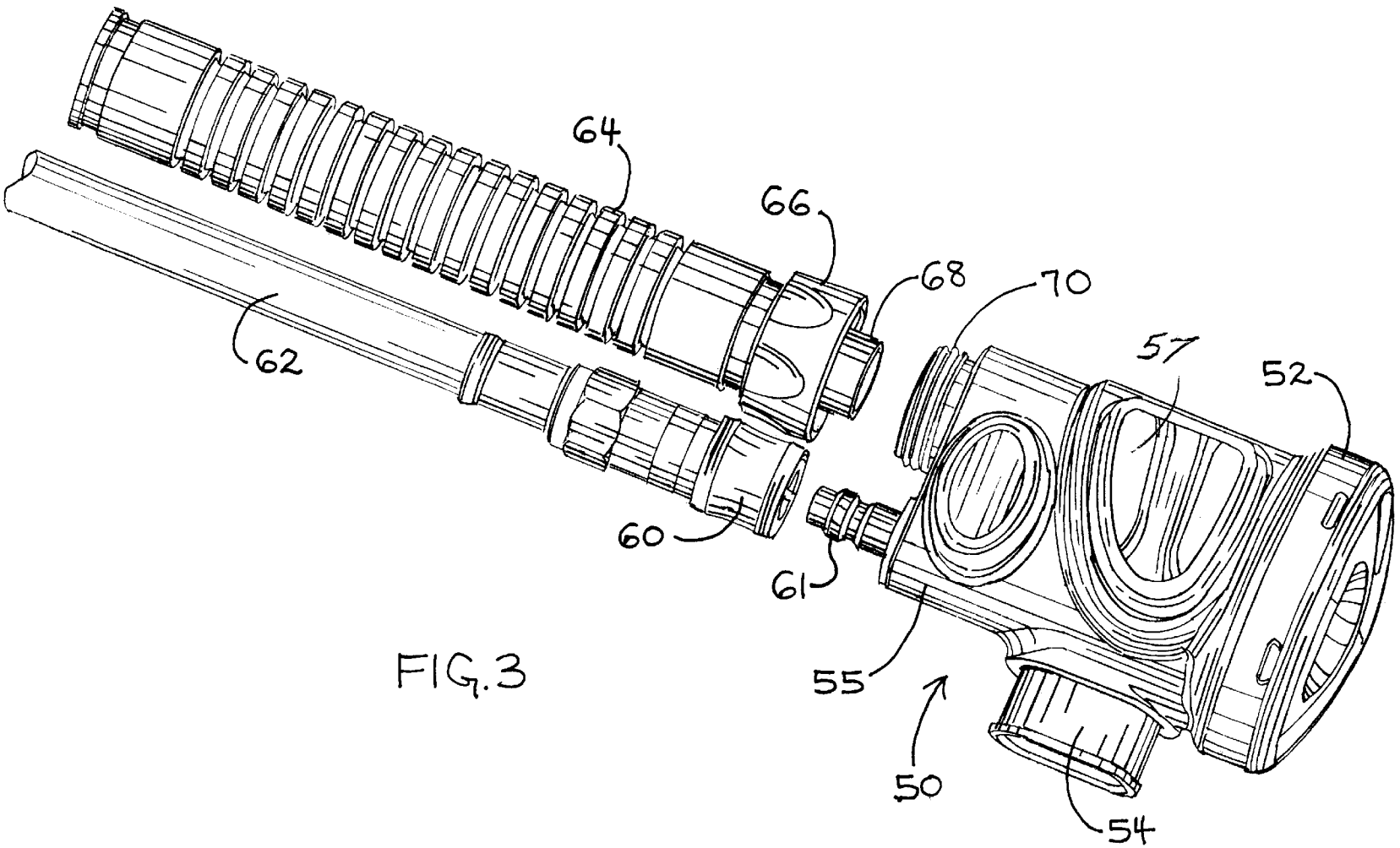
FIG. 3 is a view similar to that of FIG. 2 but with the inflator regulator shown disconnected from the hoses.
Figure 4:
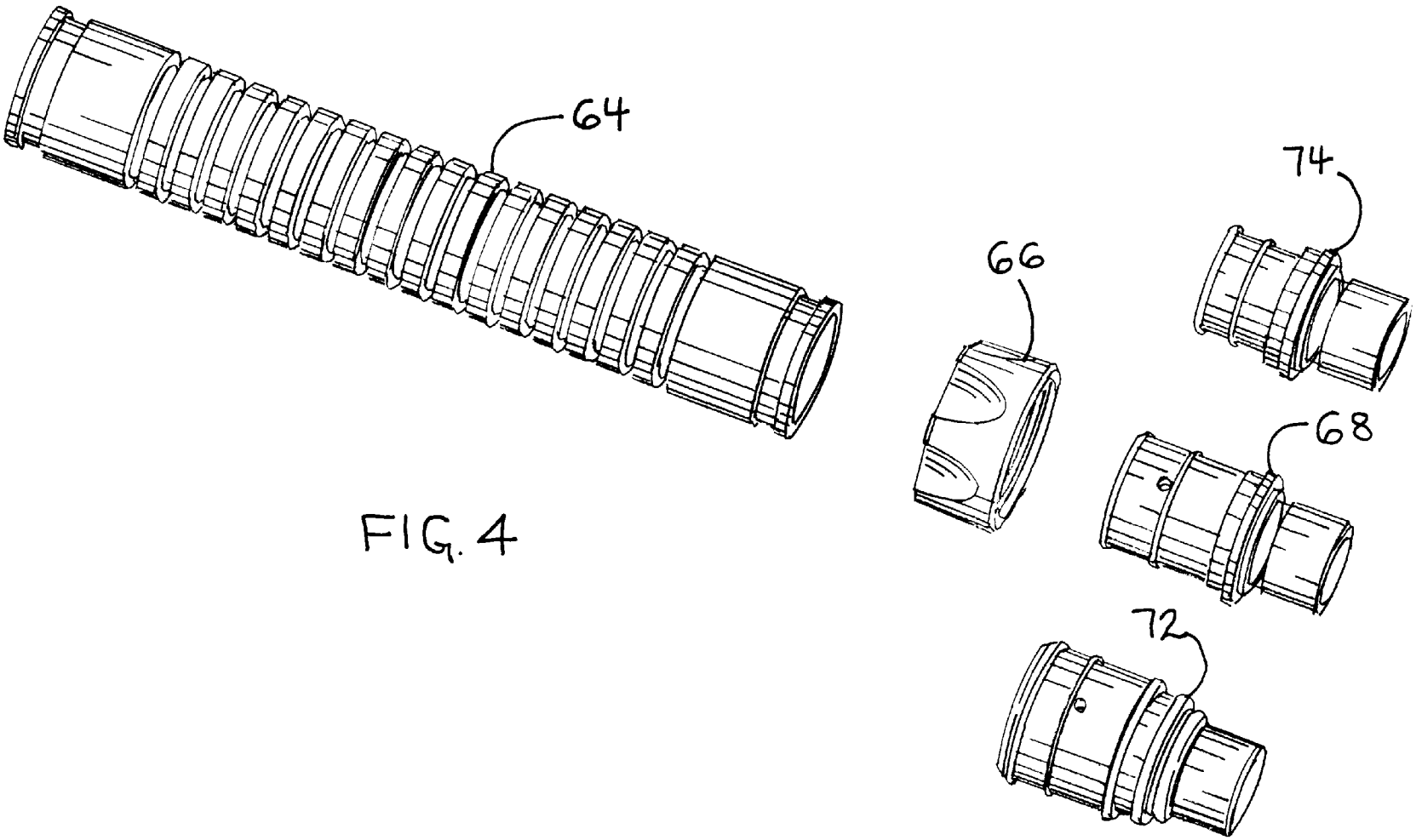
FIG. 4 is a view of a plurality of adapters from which one is selected for connection to a particular size BC hose.

An enlarged view of an inflator regulator 50 according to a preferred embodiment of the present invention is shown in FIGS. 2 to 4. Inflator regulator 50 is shown in FIG. 2 connected to a hose 62 by a quick disconnect 60 which provides first stage regulator air to the inflator regulator. It is also connected to a BC hose 64 by a threaded sleeve 66 which provides inflation air to a buoyancy compensator (not shown). Inflator regulator 50 comprises a body member 55 to which there is connected a breathing regulator housing 52, a mouthpiece nipple 54 an inflation actuator 56 and a deflation actuator 57.

In FIG. 3 it will be seen that the inflator regulator also comprises a mating quick disconnect connector 61 and a mating threaded connector 70, the latter configured for threadable engagement with sleeve 66 around adapter 68. As seen in FIG. 4, adapter 68 is one of a plurality of adapters including, for example, adapters 72 and 74. Each such adapter is configured to mate with a different size BC hose while having the same interface with the inflator regulator 50.

As shown further in FIG. 4, each adapter 68, 72 and 74 has a pair of integral radial barbs 76 which are canted toward a nipple 75. The barbs provide a secure interface with the interior of hose 64. Nipple 75 of each adapter is identical for interfacing with the body 56 of inflator regulator 50 through threaded connection 70. It is contemplated that a diver having more than one BC would assemble a sleeve 66 and the appropriate adapter into the BC hose and then simply disconnect sleeve 66 from connection 70 to transfer inflator regulator 50 from one BC to another BC. Therefore, in practice, each adapter would be preferably provided with a separate sleeve 66.

It will thus be seen that the present invention provides a convenient BC hose/inflator regulator interface which permits the inflator regulator to be connected to a plurality of different BC hoses and thus different BCs. This permits a diver to use a BC of one manufacturer and an inflator regulator of another. Moreover, because the invention provides for easy disconnection of the BC hose from the inflator regulator, a diver may readily store the inflator regulator in a safe place separate from the BC such as with his or her primary second stage regulator and sensitive gauges. The invention may be used on BC inflators as well as inflator regulators.

Having thus disclosed a preferred illustrative embodiment of the invention, what is claimed is:

1. An inflator regulator for scuba diving, the inflator regulator having a first connection for mating with a pressure line supplying pressurized air from a first stage regulator and having a second connection for mating with a hose connected to a buoyancy compensator for selective inflation and deflation of the buoyancy compensator; the inflator regulator comprising:

a plurality of different size adapters for mating with a corresponding plurality of different diameter buoyancy compensator hoses, each said adapter being configured for receiving a threaded sleeve;

said threaded sleeve and said second connection having matching threads for releasably securing each adapter to the inflator regulator.

2. In combination with an inflator having a receptacle for mating with inflation/deflation hoses of scuba diving buoyancy jackets; a plurality of adapters comprising:

at least one adapter having a first diameter for connection to one said hose of a selected first diameter;

at least one adapter having a second diameter for connection to one said hose of a selected second diameter, said first and second diameters being different from one another;

each said adapter being configured for engaging said receptacle and each said adapter having an identical end member for engagement with said inflator within said receptacle.

3. A scuba diving inflator regulator comprising:

a connector for receiving an inflation/deflation hose of a buoyancy compensator;

a sleeve for mating with said connector;

a plurality of adapters each having a first end for engaging said sleeve and each having a second end for engaging the interior of a buoyancy compensator hose; at least two of said adapters having respective second ends of different diameters for engaging different diameter hose interiors.

4. The inflator regulator recited in claim 3 wherein said respective first ends of said at least two adapters are of equal diameter.

* * * * *